US009303601B2

(12) United States Patent
Aso

(10) Patent No.: US 9,303,601 B2
(45) Date of Patent: Apr. 5, 2016

(54) EVAPORATIVE FUEL TREATMENT APPARATUS

(71) Applicant: Shuichi Aso, Toyota (JP)

(72) Inventor: Shuichi Aso, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 165 days.

(21) Appl. No.: 14/155,728

(22) Filed: Jan. 15, 2014

(65) Prior Publication Data

US 2014/0196695 A1 Jul. 17, 2014

(30) Foreign Application Priority Data

Jan. 17, 2013 (JP) ..... 2013-006400

(51) Int. Cl.
*F02M 1/00* (2006.01)
*F02M 25/08* (2006.01)
*F02M 37/10* (2006.01)

(52) U.S. Cl.
CPC ..... *F02M 25/0854* (2013.01); *F02M 37/106* (2013.01)

(58) Field of Classification Search
CPC ..... F02M 25/08; F02M 25/0836
USPC ..... 123/516, 518, 519
See application file for complete search history.

(56) References Cited

U.S. PATENT DOCUMENTS 4,919,103 A 4/1990 Ishiguro et al.
2003/0041842 A1* 3/2003 Kumagai ..... F02M 37/0029 123/458
2007/0163659 A1* 7/2007 Uhara ..... B60K 15/03 137/565.17
2010/0294251 A1* 11/2010 Makino ..... F02M 25/0836 123/519
2011/0137470 A1* 6/2011 Surnilla ..... G01C 21/26 700/282
2013/0233733 A1* 9/2013 Yamamoto ..... B60K 15/03177 206/204
2014/0165972 A1* 6/2014 Aso ..... F02M 25/0854 123/520

FOREIGN PATENT DOCUMENTS

JP 64-000347 A 1/1989
JP 2010-121560 A 6/2010
JP 2012-097640 A 5/2012
JP 2014-074384 A 4/2014
JP 2014-101872 A 6/2014
WO 2014020893 A1 2/2014

* cited by examiner

*Primary Examiner* — John Kwon
(74) *Attorney, Agent, or Firm* — Dinsmore & Shohl LLP

(57) ABSTRACT

The evaporative fuel treatment apparatus includes: a fuel tank configured to store fuel for an engine; a sub-tank that communicates with the fuel tank; an adsorber provided inside the sub-tank and configured to adsorb evaporative fuel generated inside at least one of the fuel tank and the sub-tank; a purge mechanism configured to carry out purging for introducing evaporative fuel from the adsorber into the engine; and an in-tank fuel adjustment unit configured to adjust an amount of fuel inside the sub-tank in response to an operating state of the engine, the in-tank fuel adjustment unit including a fuel introduction pump configured to be able to introduce fuel from an outside of the sub-tank to an inside of the sub-tank, the fuel introduction pump being formed of a jet pump configured to be driven by at least part of fuel discharged from the fuel pump.

8 Claims, 7 Drawing Sheets

EVAPORATIVE FUEL TREATMENT APPARATUS

INCORPORATION BY REFERENCE

The disclosure of Japanese Patent Application No. 2013-006400 filed on Jan. 17, 2013 including the specification, drawings and abstract is incorporated herein by reference in its entirety.

BACKGROUND OF THE INVENTION

1. Field of the Invention

The invention relates to an evaporative fuel treatment apparatus.

2. Description of Related Art

There is known an existing evaporative fuel treatment apparatus in which a partition wall is provided inside a fuel tank, a small fuel storage chamber is defined by the partition wall inside the fuel tank, a canister is accommodated in the small fuel storage chamber, the canister is cooled by introducing fed fuel into the small fuel storage chamber during refueling, and the canister is heated by introducing high-temperature returned fuel into the small fuel storage chamber during engine operation, thus facilitating the fuel adsorption action and fuel desorption action of the canister (for example, see Japanese Patent Application Publication No. 64-000347 (JP 64-000347 A)).

However, in the existing evaporative fuel treatment apparatus, the amount of fuel inside the small fuel storage chamber depends on the amount of returned fuel, the area of an opening portion of the small fuel storage chamber which serves as an overflow passage between the small fuel storage chamber and the inside of the fuel tank, and the area of a small hole that communicates the small fuel storage chamber with the inside of the fuel tank.

Therefore, the existing evaporative fuel treatment apparatus is not able to adequately adjust the temperature inside the canister (hereinafter, also referred to as "adsorber"), so there is an inconvenience that it is not possible to sufficiently exercise the evaporative fuel adsorption performance and adsorbed fuel desorption performance of the adsorber.

SUMMARY OF THE INVENTION

The invention provides an evaporative fuel treatment apparatus that is able to sufficiently exercise the evaporative fuel adsorption performance and adsorbed fuel desorption performance of the adsorber.

An aspect of the invention provides an evaporative fuel treatment apparatus. The evaporative fuel treatment apparatus includes: a fuel tank configured to store fuel for an internal combustion engine; a sub-tank that communicates with the fuel tank; a fuel pump configured to draw fuel that is supplied from the sub-tank to the internal combustion engine; an adsorber provided inside the sub-tank and configured to adsorb evaporative fuel generated inside at least one of the fuel tank and the sub-tank; a purge mechanism configured to carry out purging for introducing evaporative fuel from the adsorber into an intake pipe of the internal combustion engine; and an in-tank fuel adjustment unit configured to adjust an amount of fuel inside the sub-tank in response to an operating state of the internal combustion engine, the in-tank fuel adjustment unit including a fuel introduction pump configured to be able to introduce fuel from an outside of the sub-tank to an inside of the sub-tank, the fuel introduction pump being formed of a jet pump configured to be driven by at least part of fuel discharged from the fuel pump.

With this configuration, the evaporative fuel treatment apparatus according to the aspect of the invention is able to adjust the amount of heat that is transmitted from the fuel pump to the adsorber by adjusting the amount of fuel inside the sub-tank in response to the operating state of the internal combustion engine. In addition, the evaporative fuel treatment apparatus according to the aspect of the invention is able to adjust fuel that is introduced from the outside of the sub-tank to the inside of the sub-tank inside the fuel tank by controlling the driving amount of the fuel introduction pump, so it is possible to adequately adjust the temperature inside the adsorber. Furthermore, the evaporative fuel treatment apparatus according to the aspect of the invention does not need to additionally provide a power source, such as an electric pump, so it is possible to reduce manufacturing cost.

Thus, the evaporative fuel treatment apparatus according to the aspect of the invention is able to adequately adjust the temperature inside the adsorber, so it is possible to sufficiently exercise the evaporative fuel adsorption performance and adsorbed fuel desorption performance of the adsorber, In the evaporative fuel treatment apparatus according to the above aspect, the in-tank fuel adjustment unit may be configured to adjust the amount of fuel inside the sub-tank so as not to increase the amount of fuel on the condition that an increase in the temperature of the adsorber is required.

With this configuration, the evaporative fuel treatment apparatus according to the aspect of the invention is able to prevent an increase in the thermal capacity of fuel inside the sub-tank by causing fuel inside the sub-tank not to increase when an increase in the temperature of the adsorber is required as in the case, for example, when purging is carried out.

Thus, the evaporative fuel treatment apparatus according to the aspect of the invention prevents a situation that the temperature inside the adsorber is hard to increase by preventing a situation that the temperature of fuel inside the sub-tank is hard to increase, so it is possible to sufficiently exercise the adsorbed fuel desorption performance of the adsorber.

In addition, in the evaporative fuel treatment apparatus according to the above aspect, the in-tank fuel adjustment unit may be configured to adjust the amount of fuel inside the sub-tank so as to increase the amount of fuel on the condition that a decrease in the temperature of the adsorber is required.

With this configuration, the evaporative fuel treatment apparatus according to the aspect of the invention actively introduce relatively low-temperature fuel outside the sub-tank into the sub-tank when a decrease in the temperature of the adsorber is required as in the case, for example, when the fuel tank is refueled, so it is possible to decrease the temperature inside the adsorber, and it is possible to sufficiently exercise the evaporative fuel adsorption performance of the adsorber.

According to the aspect of the invention, it is possible to provide the evaporative fuel treatment apparatus that is able to sufficiently exercise the evaporative fuel adsorption performance and adsorbed fuel desorption performance of the adsorber.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, embodiments of an evaporative fuel treatment apparatus according to the invention will be described with reference to the accompanying drawings.

Figure 1:
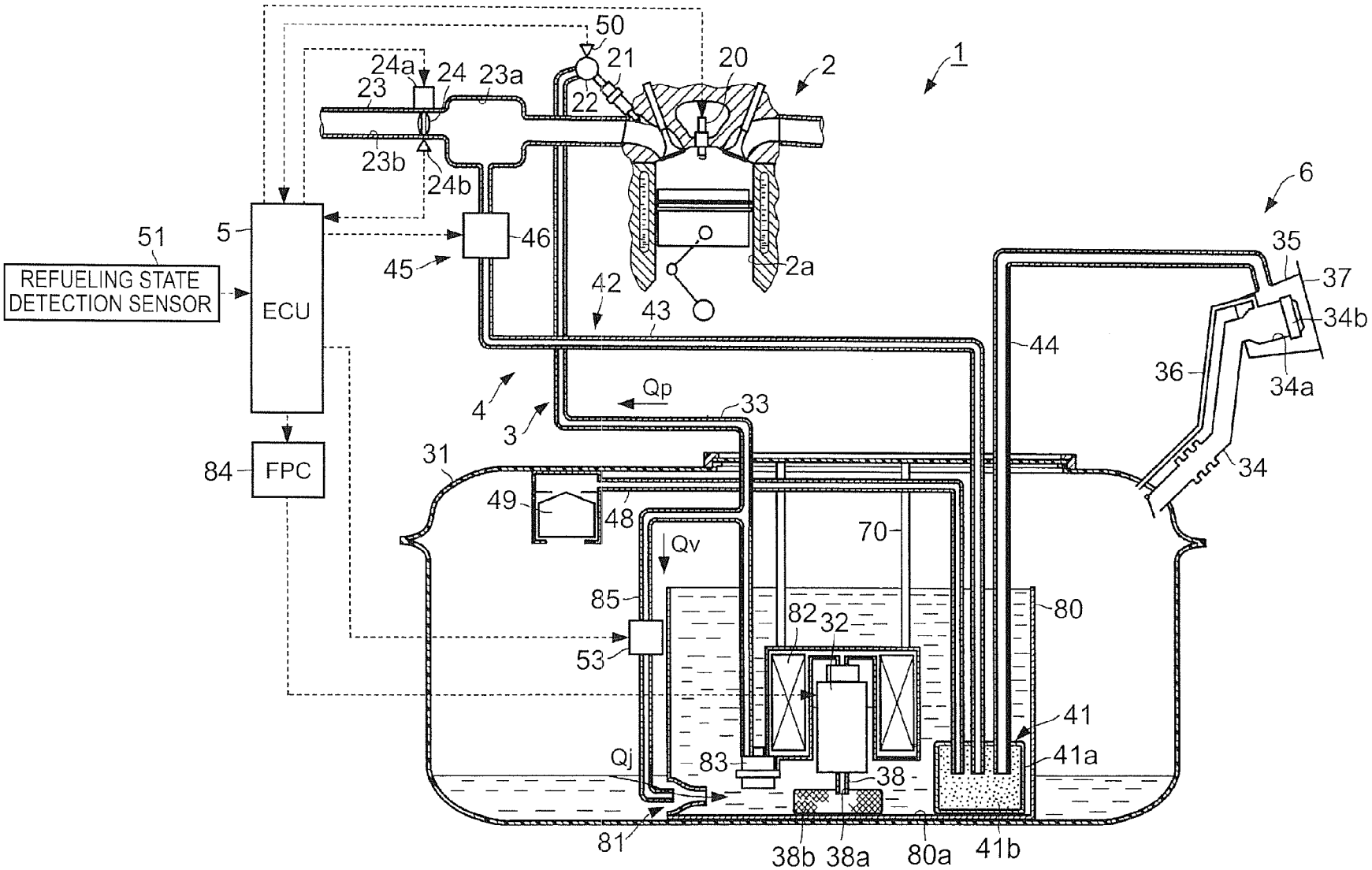
FIG. 1 is a schematic configuration view of a relevant portion, including a driving internal combustion engine and a fuel system of the internal combustion engine, in a vehicle on which an evaporative fuel treatment apparatus according to a first embodiment of the invention is mounted.

FIG. 1 shows the configuration of a relevant portion of a vehicle on which the evaporative fuel treatment apparatus according to a first embodiment of the invention, that is, the mechanism of a driving internal combustion engine and a fuel system that supplies fuel to the internal combustion engine and purges fuel from the fuel tank. The internal combustion engine according to the first embodiment uses highly-volatile fuel, and is mounted on the vehicle in order to propel the vehicle.

First, the configuration will be described.

As shown in FIG. 1, the vehicle 1 according to the first embodiment includes an engine 2, a fuel supply mechanism 3 having a fuel tank 31, a fuel purge system 4 that constitutes the evaporative fuel treatment apparatus, and an electronic control unit (ECU) 5.

The engine 2 is formed of a spark-ignition multi-cylinder internal combustion engine, for example, a four-cycle in-line four-cylinder engine, that uses ignition plugs 20 controlled by the ECU 5.

Injectors 21 (fuel injection valves) are respectively mounted at intake port portions of four cylinders 2*a* (only one of them is shown in FIG. 1) of the engine 2, and the plurality of injectors 21 are connected to a delivery pipe 22.

Highly-volatile fuel (for example, gasoline) is pressurized to a fuel pressure required of the engine 2, and is supplied from a fuel pump 32 (described later) to the delivery pipe 22.

An intake pipe 23 is connected to the intake port portions of the engine 2. A surge tank 23*a* is provided in the intake pipe 23. The surge tank 23*a* has a predetermined volume and is used to suppress intake pulsation and intake interference.

An intake passage 23*b* is formed inside the intake pipe 23. A throttle valve 24 is provided in the intake passage 23*b*. The throttle valve 24 is driven by a throttle actuator 24*a* such that the opening degree is adjustable.

The throttle valve 24 adjusts the intake air amount of the engine 2 by adjusting the opening degree of the intake passage 23*b* in accordance with control from the ECU 5. A throttle sensor 24*b* is provided at the throttle valve 24. The throttle sensor 24*b* detects the opening degree of the throttle valve 24.

The fuel supply mechanism 3 includes the fuel tank 31, a sub-tank 80, the fuel pump 32, a fuel supply line 33 and a suction line 38. The sub-tank 80 is provided inside the fuel tank 31. The fuel supply line 33 connects the delivery pipe 22 to the fuel pump 32. The suction line 38 is provided upstream of the fuel pump 32.

The fuel tank 31 is arranged at the lower side of the body of the vehicle 1, and stores fuel that is consumed by the engine 2 so as to be able to supply the fuel. The sub-tank 80 is formed in a substantially cylindrical shape with a bottom 80*a*. The upper portion of the sub-tank 80 is open such that the sub-tank 80 communicates with the fuel tank 31. The sub-tank 80 is provided inside the fuel tank 31.

The sub-tank 80 is able to store fuel inside. Specifically, the sub-tank 80 includes a jet pump 81 that introduces fuel inside the fuel tank 31 into the sub-tank 80.

The jet pump 81 constitutes a fuel introduction pump that is able to introduce fuel from the outside of the sub-tank 80 to the inside of the sub-tank 80. The jet pump 81 is disposed inside the fuel tank 31. Specifically, the jet pump 81 is driven by at least part of fuel discharged from the fuel pump 32, and introduces fuel into the sub-tank 80 in response to the operation of the fuel pump 32.

The shape of the sub-tank 80 is not limited to the cylindrical shape, and may be a square tubular shape or a box shape. The shape of the sub-tank 80 is not specifically limited. A canister 41, a suction filter 38*b*, a fuel filter 82 and a pressure regulator 83 are accommodated inside the sub-tank 80 in addition to the fuel pump 32.

The fuel pump 32 is of a variable discharge capacity (displacement and discharge pressure) type that is able to draw fuel inside the fuel tank 31 and pressurize the fuel to a predetermined feed fuel pressure or higher, and is, for example, formed of a circumferential flow pump. Although the detailed internal configuration of the fuel pump 32 is not shown, the fuel pump 32 includes a pump driving impeller and a built-in motor that drives the impeller.

The fuel pump 32 is able to change its discharge capacity per unit time by changing at least one of the rotation speed and rotation torque of the pump driving impeller in accordance with the driving voltage and load torque of the built-in motor.

In order to change the discharge capacity of the fuel pump 32 in this way, the fuel supply mechanism 3 includes a fuel pump controller (FPC) 84 that controls the driving voltage of the fuel pump 32 in response to control from the ECU 5.

The casing of the fuel filter 82 is held inside the sub-tank 80 integrally with the fuel pump 32 by a holding mechanism 70. The fuel filter 82 filters fuel discharged from the fuel pump 32. In the first embodiment, the fuel filter 82 is a known one. The casing of the fuel filter 82 is formed so as to surround the fuel pump 32, and filters fuel discharged from the fuel pump 32.

The pressure regulator 83 is formed of an emergency normally-closed valve provided downstream of the fuel filter 82. The pressure regulator 83 opens when the fuel pressure in the fuel filter 82 becomes higher than or equal to a predetermined fuel pressure, and returns redundant fuel into the sub-tank 80.

The fuel supply line 33 forms a fuel supply passage that communicates an output port of the pressure regulator 83 and the inside of the delivery pipe 22 with each other. A pilot line 85 is connected to the fuel supply line 33. The pilot line 85 is used to supply driving flow to the jet pump 81 by returning at least part of fuel discharged from the fuel pump 32 inside the fuel tank 31.

Here, in FIG. 1, the pilot line 85 and the fuel supply line 33 are shown as substantially equivalent lines; however, the passage cross-sectional areas of the pilot line 85 and fuel supply line 33 may be varied or an appropriate throttle may be provided in the pilot line 85 in accordance with the set ratio of the maximum flow rate of fuel inside the pilot line 85 to the maximum flow rate of fuel inside the fuel supply line 33.

An adjustment flow reduction valve 53 is provided in the pilot line 85. The adjustment flow reduction valve 53 is able to change the driving flow rate of the jet pump 81 by changing the opening degree of a halfway portion of the pilot line 85 in response to control from the ECU 5.

That is, the adjustment flow reduction valve 53 is able to adjust the amount of fuel that is introduced from the outside of the sub-tank 80 to the inside of the sub-tank 80 inside the fuel tank 31 by changing the opening degree of a halfway portion of the pilot line 85 in response to control from the ECU 5.

The suction line 38 forms a suction passage 38*a* upstream of the fuel pump 32. The suction filter 38*b* is provided at the most upstream portion of the suction passage 38*a*. The suction filter 38*b* is a known one, and filters fuel that is introduced into the fuel pump 32.

A refueling mechanism 6 for feeding fuel into the fuel tank 31 is provided on the fuel tank 31. The refueling mechanism 6 includes a refueling pipe 34, a cap 34*b*, a fuel inlet box 35, a circulation line 36 and a fuel lid 37. The refueling pipe 34 protrudes from the fuel tank 31 laterally or rearward of the vehicle 1. The cap 34*b* is detachably attached to a fuel inlet 34*a*. The fuel inlet box 35 is provided at the body (not shown) of the vehicle 1 so as to accommodate the fuel inlet 34*a* formed at the distal end of the refueling pipe 34 in the protruding direction. The circulation line 36 communicates the upper portion of the fuel tank 31 with the upstream portion inside the refueling pipe 34. The fuel lid 37 opens or closes the fuel inlet 34*a* to the outside.

The refueling mechanism 6 allows fuel to be poured into the fuel tank 31 via the fuel inlet 34*a* by opening the fuel lid 37 and removing the cap 34*b* detachably attached to the fuel inlet 34*a*.

The fuel purge system 4 is provided between the fuel tank 31 and the intake pipe 23, more specifically, between the fuel tank 31 and the surge tank 23*a*. The fuel purge system 4 is able to release evaporative fuel generated inside at least one of the fuel tank 31 and the sub-tank 80 to the intake passage 23*b* at the time of the intake stroke of the engine 2 and cause the released evaporative fuel to combust.

The fuel purge system 4 includes the canister 41, a purge mechanism 42 and a purge control mechanism 45. The canister 41 adsorbs evaporative fuel generated inside the fuel tank 31. The purge mechanism 42 canies out purging for introducing purge gas, including fuel and air, into the intake pipe 23 of the engine 2. The purge gas is desorbed from the canister 41 by passing air through the canister 41. The purge control mechanism 45 suppresses fluctuations in air-fuel ratio in the engine 2 by controlling the amount of purge gas that is introduced into the intake pipe 23.

The canister 41 contains an adsorbent 41*b*, such as activated carbon, inside a canister case 41*a*, and is held inside the sub-tank 80 via a holding mechanism (not shown), or the like. The inside (adsorbent containing space) of the canister 41 communicates with an upper space inside the fuel tank 31 via an evaporation line 48 and a gas-liquid separation valve 49.

Thus, when fuel evaporates inside the fuel tank 31 and evaporative fuel accumulates in the upper space inside the fuel tank 31, the canister 41 is able to adsorb evaporative fuel with the use of the adsorbent 41*b*. In addition, when the liquid level of fuel rises or the liquid level of fuel fluctuates inside the fuel tank 31, the gas-liquid separation valve 49 having a check valve function floats and closes the distal end portion of the evaporation line 48.

The purge mechanism 42 includes a purge line 43 and an atmosphere line 44. The purge line 43 communicates the inside of the canister 41 with the internal portion of the surge tank 23*a* within the intake passage 23*b* of the intake pipe 23. The atmosphere line 44 opens the inside of the canister 41 to an atmosphere side, for example, an atmospheric pressure space inward of the fuel inlet box 35.

When an intake negative pressure is generated inside the surge tank 23*a* during operation of the engine 2, the purge mechanism 42 is able to introduce the intake negative pressure to one end side inside the canister 41 through the purge line 43, and introduce the atmosphere to the other end side inside the canister 41 through the atmosphere line 44.

Thus, the purge mechanism 42 is able to desorb (release) fuel, adsorbed by the adsorbent 41*b* of the canister 41 and held inside the canister 41, from the canister 41 and introduce the fuel into the surge tank 23*a*.

The purge control mechanism 45 includes a purging vacuum solenoid valve (hereinafter, referred to as "purging VSV") 46 that is controlled by the ECU 5.

The purging VSV 46 is provided in the purge line 43. The purging VSV 46 is able to variably control the amount of evaporative fuel that is desorbed from the canister 41 by changing the opening degree of a halfway portion of the purge line 43.

Specifically, the purging VSV 46 is able to change its opening degree through duty control over its exciting current by the ECU 5, and is able to introduce fuel desorbed from the canister 41 due to the intake negative pressure in the intake pipe 23 into the surge tank 23*a* as purge gas together with air at a purge rate based on the duty ratio.

The ECU 5 is formed of a microprocessor that includes a central processing unit (CPU) (not shown), a read only memory (ROM) (not shown), a random access memory (RAM) (not shown), a flash memory (not shown) and an input/output port (not shown).

A program for causing the microprocessor to function as the ECU 5 is stored in the ROM of the ECU 5. That is, the CPU of the ECU 5 executes the program stored in the ROM using the RAM as a work area. Thus, the microprocessor functions as the ECU 5.

Various sensors are connected to the input side of the input/output port of the ECU 5. The various sensors include a fuel pressure sensor 50 and a refueling state detection sensor 51 in addition to the throttle sensor 24*b*. The fuel pressure sensor 50 detects the fuel pressure in the delivery pipe 22. The refueling state detection sensor 51 detects whether the refueling mechanism 6 is in a refueled state or a non-refueled state.

In the first embodiment, the refueling state detection sensor 51 detects that the refueling mechanism 6 is in the refueled state on the condition that the fuel lid 37 is opened, and detects that the refueling mechanism 6 is in the non-refueled state on the condition that the fuel lid 37 is closed.

The refueling state detection sensor 51 may detect that the refueling mechanism 6 is in the refueled state on the condition that the cap 34*b* has been removed from the fuel inlet 34*a*, and may detect that the refueling mechanism 6 is in the non-refueled state on the condition that the cap 34*b* has been attached to the fuel inlet 34*a*.

Various controlled objects are connected to the output side of the input/output port of the ECU 5. The various controlled objects include the ignition plugs 20, the throttle actuator 24*a*, the purging VSV 46, the adjustment flow reduction valve 53, the FPC 84, and the like.

The ECU 5 is able to control the purge rate through duty control over the purging VSV 46 on the basis of various pieces of sensor information. For example, the ECU 5 causes the purge mechanism 42 to carry out purging by actuating the purging VSV 46 on the condition that the opening degree of the throttle valve 24, obtained from the throttle sensor 24*b*, is lower than a predetermined opening degree when the engine 2 is in a predetermined operating state.

In addition, the ECU 5 constitutes an in-tank fuel adjustment unit that adjusts the amount of fuel inside the sub-tank 80 in response to the operating state of the engine 2 in cooperation with the jet pump 81 and the adjustment flow reduction valve 53.

Here, the operating state of the engine 2 means a state where the engine 2 satisfies a condition for carrying out purging with the use of the purge mechanism 42, a state where the engine 2 is stopped due to refueling of the fuel tank, or the like, as described above.

The ECU 5 adjusts the amount of fuel inside the sub-tank 80 so as not to increase the amount of fuel on the condition that an increase in the temperature of the canister is required as in the case, for example, before the purge mechanism 42 is caused to carry out purging or when the purge mechanism 42 is being caused to carry out purging.

Here, the flow rate of fuel discharged from the fuel pump 32 and flowing into the delivery pipe 22 via the fuel supply line 33 is a supply flow rate Qp, the flow rate of fuel flowing through the pilot line 85 of the jet pump 81 is a driving flow rate Qv, and the flow rate of fuel introduced by the jet pump 81 into the sub-tank 80 is a pump flow rate Qj.

On the condition that an increase in the temperature of the canister 41 is required, the ECU 5 controls the driving flow rate Qv by adjusting the adjustment flow reduction valve 53. Furthermore, the driving flow rate Qv satisfies that the supply flow rate Qp and the pump flow rate Qj are equal. That is, the ECU 5 controls the adjustment flow reduction valve 53 such that the amount of fuel inside the sub-tank 80 is kept on the condition that an increase in the temperature of the canister 41 is required.

The ECU 5 prevents an increase in the thermal capacity of fuel inside the sub-tank 80 by controlling the adjustment flow reduction valve 53 such that the amount of fuel inside the sub-tank 80 is kept on the condition that an increase in the temperature of the canister 41 is required.

In this way, the ECU 5 prevents a situation that the temperature inside the canister 41 is hard to increase by preventing a situation that the temperature of fuel inside the sub-tank 80 is hard to increase on the condition that an increase in the temperature of the canister 41 is required.

In addition, the ECU 5 adjusts the amount of fuel inside the sub-tank 80 so as to increase the amount of fuel on the condition that a decrease in the temperature of the canister 41 is required as in the case, for example, when the refueling state detection sensor 51 has detected that the refueling mechanism 6 is in the refueled state.

The ECU 5 adjusts the amount of fuel inside the sub-tank 80 so as to increase the amount of fuel irrespective of whether fuel is overflowing from the inside of the sub-tank 80.

Specifically, the ECU 5 controls the adjustment flow reduction valve 53 such that the driving flow rate Qv that satisfies that the supply flow rate Qp is lower than the pump flow rate Qj is obtained on the condition that a decrease in the temperature of the canister 41 is required.

That is, the ECU 5 decreases the temperature inside the canister 41 by controlling the adjustment flow reduction valve 53 such that relatively low-temperature fuel outside the sub-tank 80 is actively introduced into the sub-tank 80 on the condition that a decrease in the temperature of the canister 41 is required.

Figure 2:
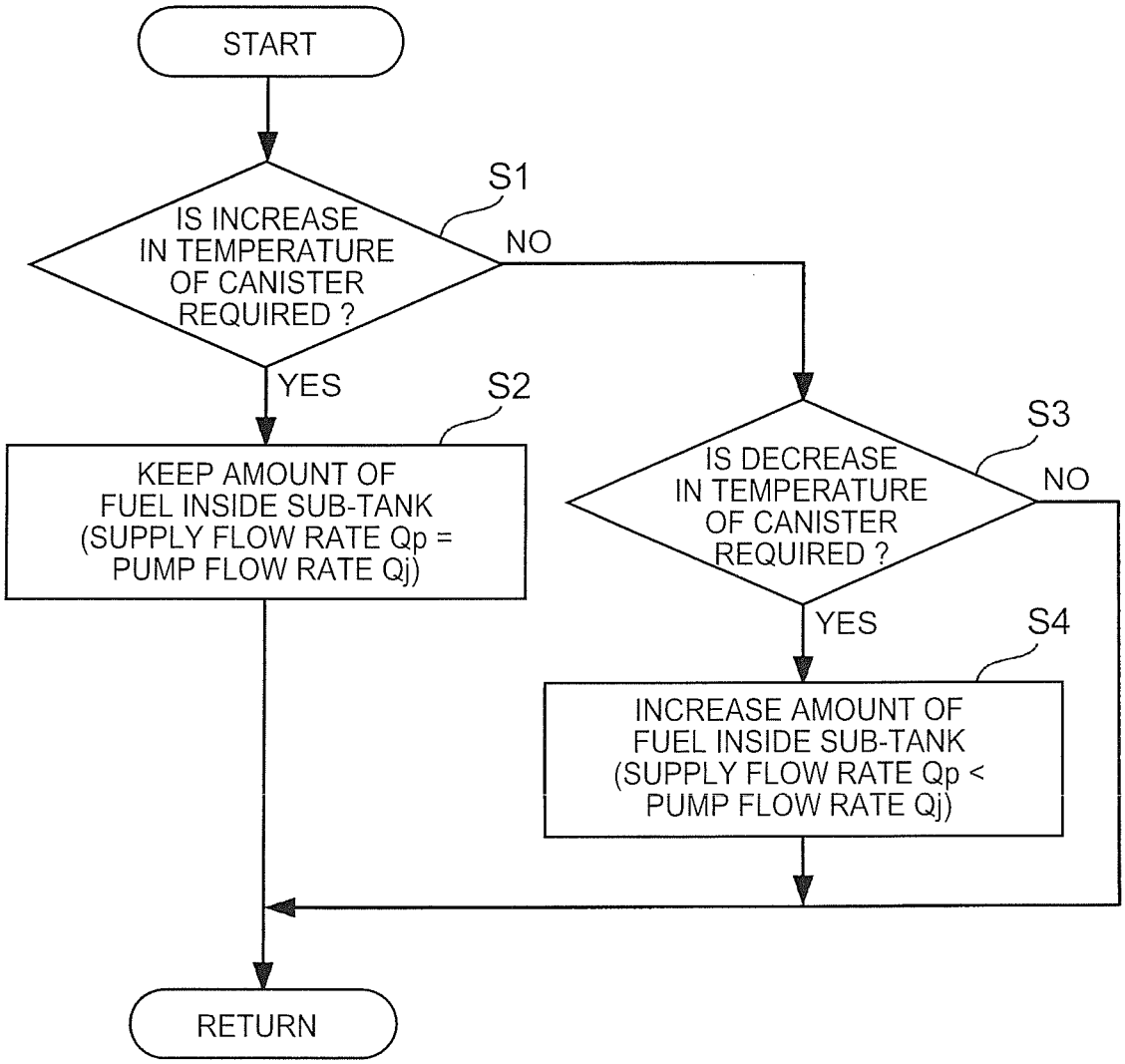
FIG. 2 is a flowchart that shows an in-tank fuel adjustment operation of the evaporative fuel treatment apparatus according to the first embodiment of the invention.

Next, an in-tank fuel adjustment operation of the evaporative fuel treatment apparatus according to the first embodiment will be described with reference to the flowchart shown in FIG. 2. The in-tank fuel adjustment operation described below is repeatedly executed while the ECU 5 is in operation.

Initially, the ECU 5 determines whether an increase in the temperature of the canister 41 is required (step S1). Here, when it is determined that an increase in the temperature of the canister 41 is required, the ECU 5 controls the adjustment flow reduction valve 53 such that the amount of fuel inside the sub-tank 80 is kept, that is, the relationship that the supply flow rate Qp is equal to the pump flow rate Qj is satisfied (step S2), and ends the in-tank fuel adjustment operation.

On the other hand, when it is determined that an increase in the temperature of the canister 41 is not required, the ECU 5 determines whether a decrease in the temperature of the canister 41 is required (step S3). Here, when it is determined that a decrease in the temperature of the canister 41 is required, the ECU 5 controls the adjustment flow reduction valve 53 such that the amount of fuel inside the sub-tank 80 is increased, that is, the relationship that the supply flow rate Qp is lower than the pump flow rate Qj is satisfied (step S4), and ends the in-tank fuel adjustment operation. On the other hand, when it is determined that a decrease in the temperature of the canister 41 is not required, the ECU 5 ends the in-tank fuel adjustment operation.

As described above, according to the first embodiment, it is possible to adjust the amount of heat that is transmitted from the fuel pump 32 to the canister 41 by adjusting the amount of fuel inside the sub-tank 80 in response to the operating state of the engine 2.

Thus, according to the first embodiment, it is possible to adequately adjust the temperature inside the canister 41, so it is possible to sufficiently exercise the evaporative fuel adsorption performance and adsorbed fuel desorption performance of the canister 41.

Particularly, according to the first embodiment, it is possible to prevent an increase in the thermal capacity of fuel inside the sub-tank 80 by keeping the amount of fuel inside the sub-tank 80 when an increase in the temperature of the canister 41 is required as in the case, for example, when purging is carried out.

Thus, the first embodiment prevents a situation that the temperature of fuel inside the canister 41 is hard to increase by preventing a situation that the temperature of fuel inside the sub-tank 80 is hard to increase when an increase in the temperature of the canister 41 is required. Therefore, it is possible to sufficiently exercise the adsorbed fuel desorption performance of the canister 41.

In addition, according to the first embodiment, relatively low-temperature fuel outside the sub-tank 80 is actively introduced into the sub-tank 80 when a decrease in the temperature of the canister 41 is required as in the case, for example, when the fuel tank 31 is refueled. Therefore, it is possible to decrease the temperature inside the canister 41, so it is possible to sufficiently exercise the evaporative fuel adsorption performance of the canister 41.

Figure 3:
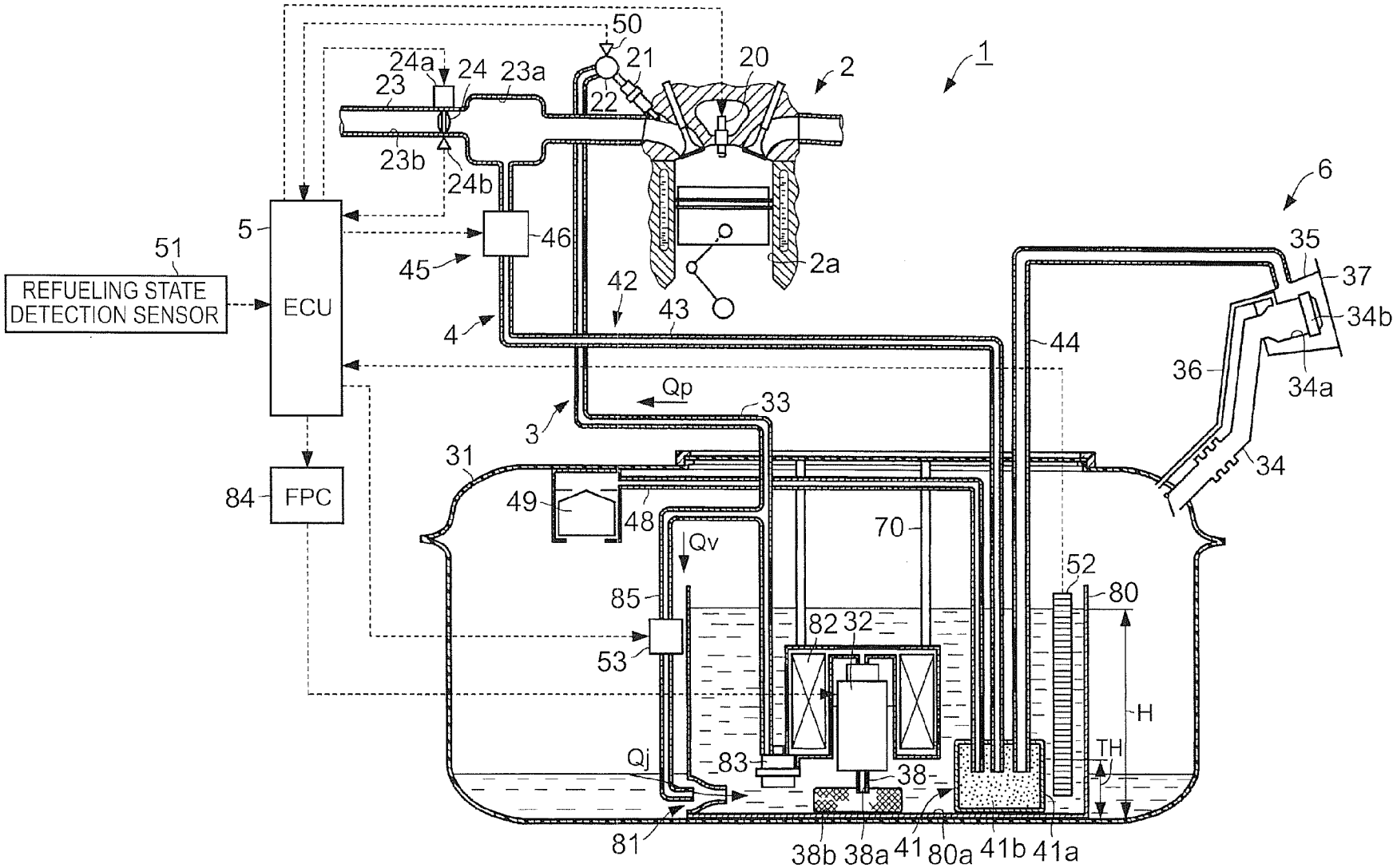
FIG. 3 is a schematic configuration view of a relevant portion, including a driving internal combustion engine and a fuel system of the internal combustion engine, in a vehicle on which an evaporative fuel treatment apparatus according to a second embodiment of the invention is mounted.

FIG. 3 shows the configuration of a relevant portion of a vehicle on which the evaporative fuel treatment apparatus according to a second embodiment of the invention, that is, the mechanism of a driving internal combustion engine and a fuel system that supplies fuel to the internal combustion engine and purges fuel from the fuel tank.

In the second embodiment, the difference from the first embodiment of the invention will be described. In the second embodiment, like reference numerals denote components similar to those of the first embodiment of the invention, and the difference will be described.

In the second embodiment, a liquid level sensor 52 is provided inside the sub-tank 80 in addition to the fuel pump 32, the canister 41, the suction filter 38*b*, the fuel filter 82 and the pressure regulator 83. The liquid level sensor 52 detects a liquid level H inside the sub-tank 80.

The liquid level sensor 52 is formed of a known liquid level sensor, such as a liquid level sensor that detects a liquid level by containing a float and a liquid level sensor that detects a liquid level on the basis of a capacitance that fluctuates on the length of a portion that contacts fuel and the length of a portion that contacts air.

In the second embodiment, a program different from the program stored in the ROM of the ECU 5 according to the first embodiment of the invention is stored in the ROM of the ECU 5. Thus, the ECU 5 according to the second embodiment controls the adjustment flow reduction valve 53 on the basis of the liquid level detected by the liquid level sensor 52 in addition to the operating state of the engine 2.

Specifically, the ECU 5 adjusts the amount of fuel inside the sub-tank 80 so as not to increase the amount of fuel on the condition that an increase in the temperature of the canister 41 is required as in the case, for example, before the purge mechanism 42 is caused to carry out purging or when the purge mechanism 42 is being caused to carry out purging.

More specifically, the ECU 5 controls the adjustment flow reduction valve 53 such that the driving flow rate Qv that satisfies that the supply flow rate Qp is higher than the pump flow rate Qj is obtained within the range in which the liquid level H inside the sub-tank 80, detected by the liquid level sensor 52, is not lower than or equal to a threshold TH on the condition that an increase in the temperature of the canister 41 is required. Here, the threshold TH is empirically predetermined to such a degree that fuel drawn by the fuel pump 32 does not become insufficient.

That is, the ECU 5 controls the adjustment flow reduction valve 53 such that the amount of fuel inside the sub-tank 80 is reduced within the range in which the liquid level H inside the sub-tank 80 is not lower than or equal to the threshold TH on the condition that an increase in the temperature of the canister 41 is required.

The ECU 5 reduces the thermal capacity of fuel inside the sub-tank 80 by controlling the adjustment flow reduction valve 53 such that the amount of fuel inside the sub-tank 80 is reduced within the range in which the liquid level H inside the sub-tank 80 is not lower than or equal to the threshold TH on the condition that an increase in the temperature of the canister 41 is required. In this way, the ECU 5 allows the temperature inside the canister 41 to easily increase by allowing the temperature of fuel inside the sub-tank 80 to easily increase.

The ECU 5 controls the adjustment flow reduction valve 53 such that the amount of fuel inside the sub-tank 80 is kept as in the case of the first embodiment of the invention in the case where the liquid level H inside the sub-tank 80, detected by the liquid level sensor 52, is lower than or equal to the threshold TH when an increase in the temperature of the canister 41 is required.

In addition, the ECU 5 adjusts the amount of fuel inside the sub-tank 80 so as to increase the amount of fuel on the condition that a decrease in the temperature of the canister 41 is required as in the case, for example, when the refueling state detection sensor 51 has detected that the refueling mechanism 6 is in the refueled state.

Specifically, the ECU 5 controls the adjustment flow reduction valve 53 such that the driving flow rate Qv that satisfies that the supply flow rate Qp is lower than the pump flow rate Qj is obtained on the condition that a decrease in the temperature of the canister 41 is required.

That is, the ECU 5 decreases the temperature inside the canister 41 by controlling the adjustment flow reduction valve 53 such that relatively low-temperature fuel outside the sub-tank 80 is actively introduced into the sub-tank 80 on the condition that a decrease in the temperature of the canister 41 is required.

Figure 4:
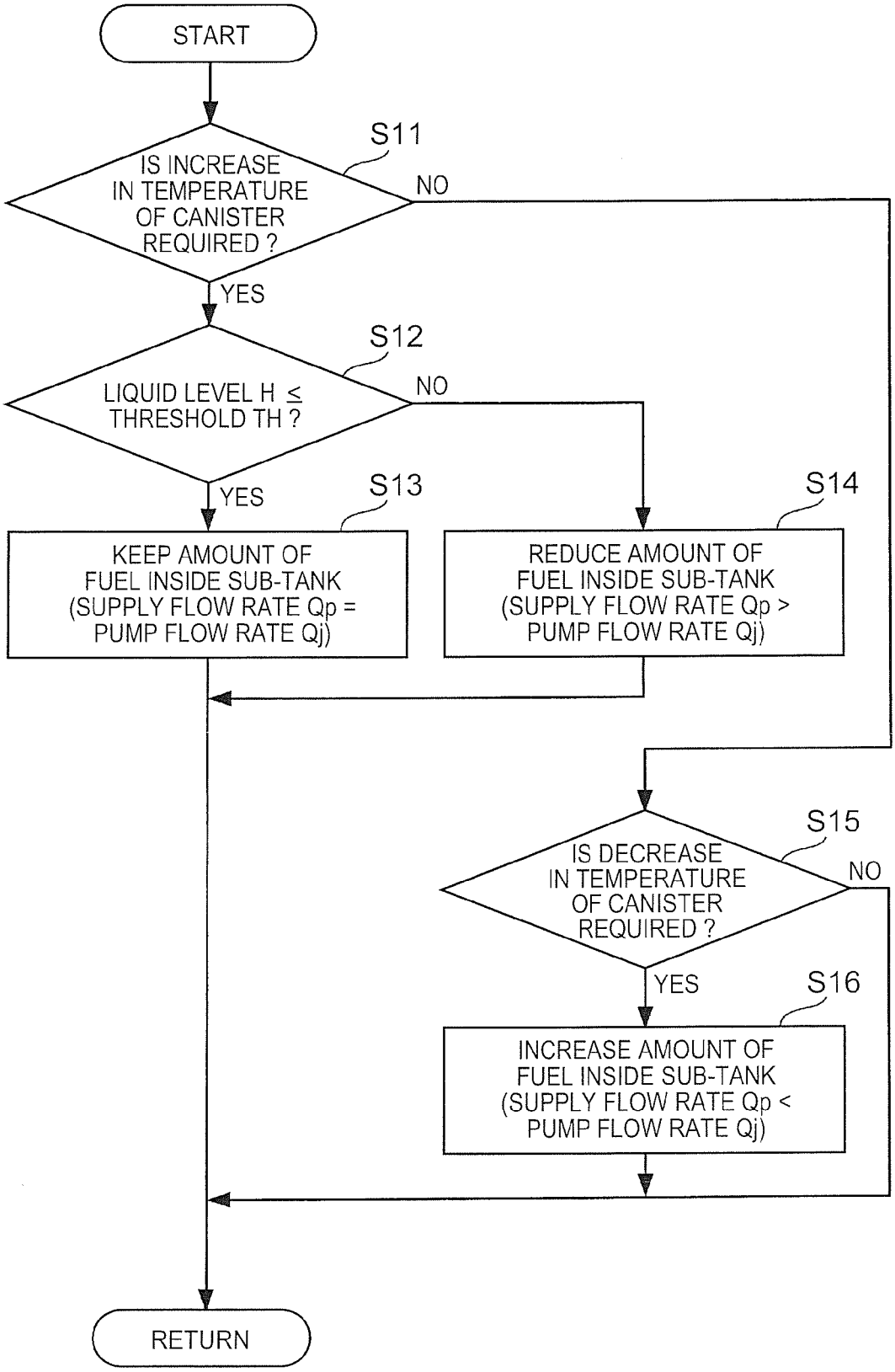
FIG. 4 is a flowchart that shows an in-tank fuel adjustment operation of the evaporative fuel treatment apparatus according to the second embodiment of the invention.

Next, an in-tank fuel adjustment operation of the evaporative fuel treatment apparatus according to the second embodiment will be described with reference to the flowchart shown in FIG. 4. The in-tank fuel adjustment operation described below is repeatedly executed while the ECU 5 is in operation.

Initially, the ECU 5 determines whether an increase in the temperature of the canister 41 is required (step S11). Here, when it is determined that an increase in the temperature of the canister 41 is required, the ECU 5 determines whether the liquid level H inside the sub-tank 80, detected by the liquid level sensor 52, is lower than or equal to the threshold TH (step S12).

Here, when it is determined that the liquid level H inside the sub-tank 80 is lower than or equal to the threshold TH, the ECU 5 controls the adjustment flow reduction valve 53 such that the amount of fuel inside the sub-tank 80 is kept, that is, the relationship that the supply flow rate Qp is equal to the pump flow rate Qj is satisfied (step S13), and ends the in-tank fuel adjustment operation.

On the other hand, when it is determined that the liquid level H inside the sub-tank 80 is not lower than or equal to the threshold TH, the ECU 5 controls the adjustment flow reduction valve 53 such that the amount of fuel inside the sub-tank 80 is reduced, that is, the relationship that the supply flow rate Qp is higher than the pump flow rate Qj is satisfied (step S14), and ends the in-tank fuel adjustment operation.

When it is determined in step S11 that an increase in the temperature of the canister 41 is not required, the ECU 5 determines whether a decrease in the temperature of the canister 41 is required (step S15).

Here, when it is determined that a decrease in the temperature of the canister 41 is required, the ECU 5 controls the adjustment flow reduction valve 53 such that the amount of fuel inside the sub-tank 80 is increased, that is, the relationship that the supply flow rate Qp is lower than the pump flow rate Qj is satisfied (step S16), and ends the in-tank fuel adjustment operation. On the other hand, when it is determined that a decrease in the temperature of the canister 41 is not required, the ECU 5 ends the in-tank fuel adjustment operation.

As described above, according to the second embodiment, it is possible to adjust the amount of heat that is transmitted from the fuel pump 32 to the canister 41 by adjusting the amount of fuel inside the sub-tank 80 in response to the operating state of the engine 2 as in the case of the first embodiment of the invention.

Thus, according to the second embodiment, it is possible to adequately adjust the temperature inside the canister 41, so it is possible to sufficiently exercise the evaporative fuel adsorption performance and adsorbed fuel desorption performance of the canister 41.

Particularly, according to the second embodiment, it is possible to reduce the thermal capacity of fuel inside the sub-tank 80 by reducing the amount of fuel inside the sub-tank 80 within the range in which the liquid level H inside the sub-tank 80 is not lower than or equal to the threshold TH when an increase in the temperature of the canister 41 is required as in the case, for example, when purging is carried out.

Thus, according to the second embodiment, the temperature inside the canister 41 is allowed to easily increase by allowing the temperature of fuel inside the sub-tank 80 to easily increase, so it is possible to sufficiently exercise the adsorbed fuel desorption performance of the canister 41.

Figure 5:
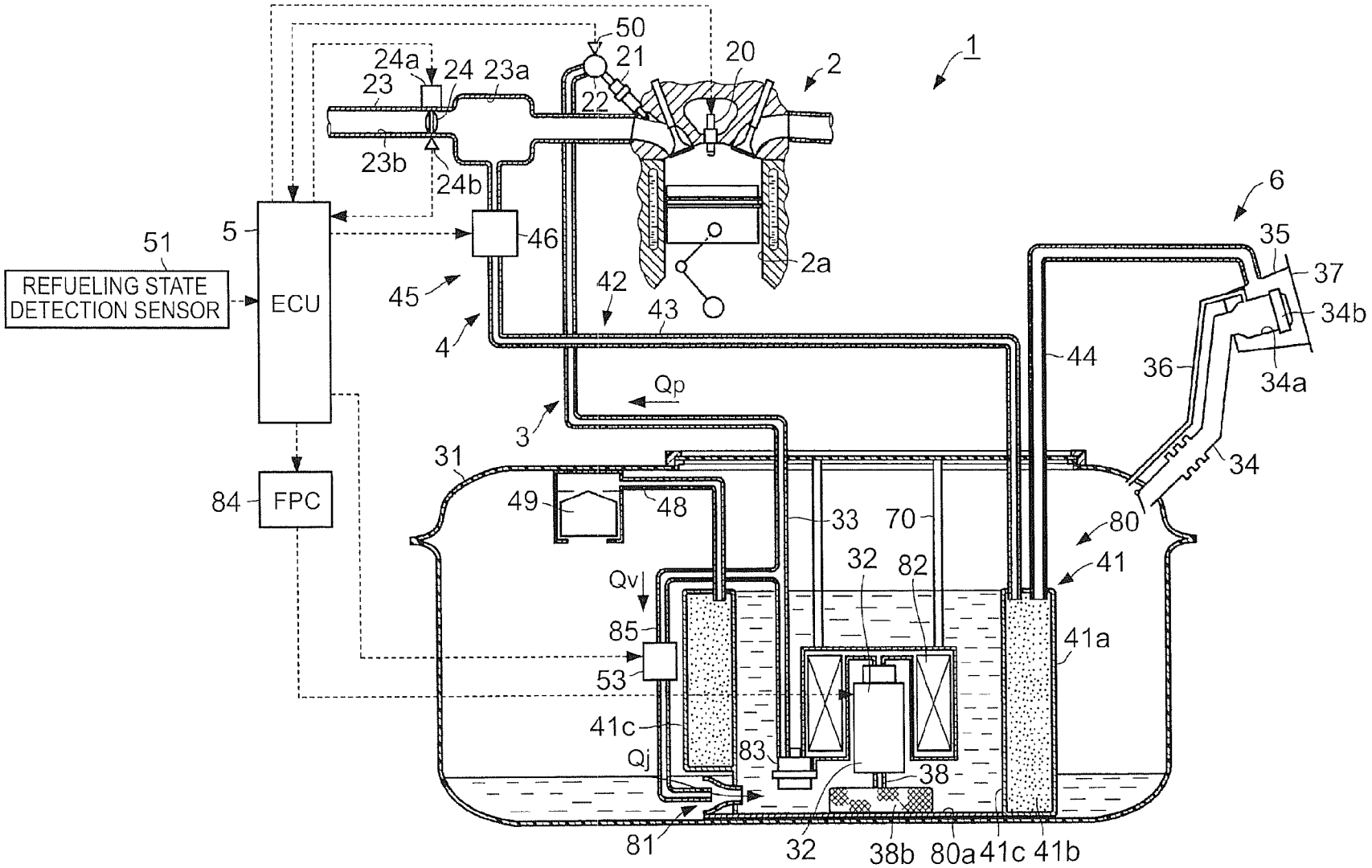
FIG. 5 is a schematic configuration view of a relevant portion, including a driving internal combustion engine and a fuel system of the internal combustion engine, in a vehicle on which an evaporative fuel treatment apparatus according to a third embodiment of the invention is mounted.

FIG. 5 shows the configuration of a relevant portion of a vehicle on which the evaporative fuel treatment apparatus according to a third embodiment of the invention, that is, the mechanism of a driving internal combustion engine and a fuel system that supplies fuel to the internal combustion engine and purges fuel from the fuel tank.

In the third embodiment, the difference from the first embodiment of the invention will be described. In the third embodiment, like reference numerals denote components similar to those of the first embodiment of the invention, and the difference will be described.

In the third embodiment, the canister 41 is formed in a substantially cylindrical shape with a bottom, and is provided inside the fuel tank 31. An outer periphery 41*c* of the canister 41 forms the sub-tank 80. The shape of the canister 41 is not limited to the cylindrical shape, and may be a square tubular shape or a box shape. The shape of the canister 41 is not specifically limited.

The fuel pump 32, the suction filter 38*b*, the fuel filter 82 and the pressure regulator 83 are accommodated inside the cylinder formed by the canister 41.

A program similar to the program stored in the ROM of the ECU 5 according to the first embodiment of the invention is stored in the ROM of the ECU 5. That is, the ECU 5 according to the third embodiment functions similarly to the ECU 5 according to the first embodiment of the invention.

As described above, according to the third embodiment, similar advantageous effects to those of the first embodiment of the invention are obtained.

Figure 6:
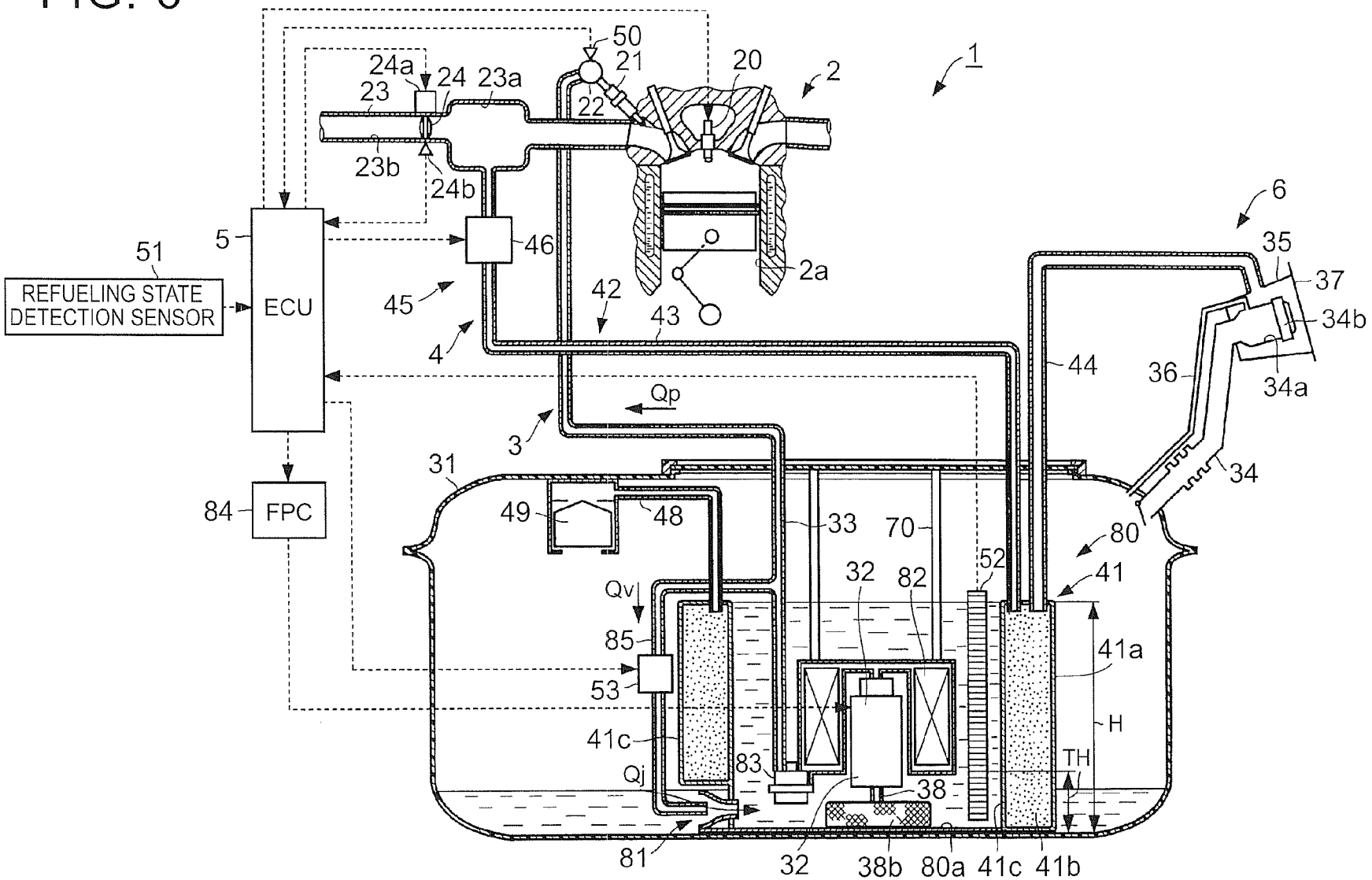
FIG. 6 is a schematic configuration view of a relevant portion, including a driving internal combustion engine and a fuel system of the internal combustion engine, in a vehicle on which an evaporative fuel treatment apparatus according to a first alternative embodiment to the third embodiment of the invention is mounted.

As shown in FIG. 6, the liquid level sensor 52 that detects the liquid level H inside the sub-tank 80 is provided in the third embodiment of the invention as in the case of the second embodiment of the invention, and the ECU 5 is caused to function similarly to the ECU 5 according to the second embodiment of the invention. Thus, advantageous effects similar to those of the second embodiment of the invention are obtained.

The alternative embodiment to the third embodiment of the invention, shown in FIG. 6, can be easily conceived of on the basis of the description of the second and third embodiments of the invention, so the description thereof is omitted.

In addition, in each of the first to third embodiments of the invention, the description is made on the configuration that is able to adjust the amount of heat that is transmitted from the fuel pump 32 to the canister 41 by accommodating the canister 41 and the fuel pump 32 inside the sub-tank 80 and adjusting the amount of fuel inside the sub-tank 80.

In this way, another configuration may be employed as long as a configuration is able to adjust the amount of heat that is transmitted from the fuel pump 32 to the canister 41 by accommodating the canister 41 and the fuel pump 32 inside the sub-tank 80 and adjusting the amount of fuel inside the sub-tank 80.

Figure 7:
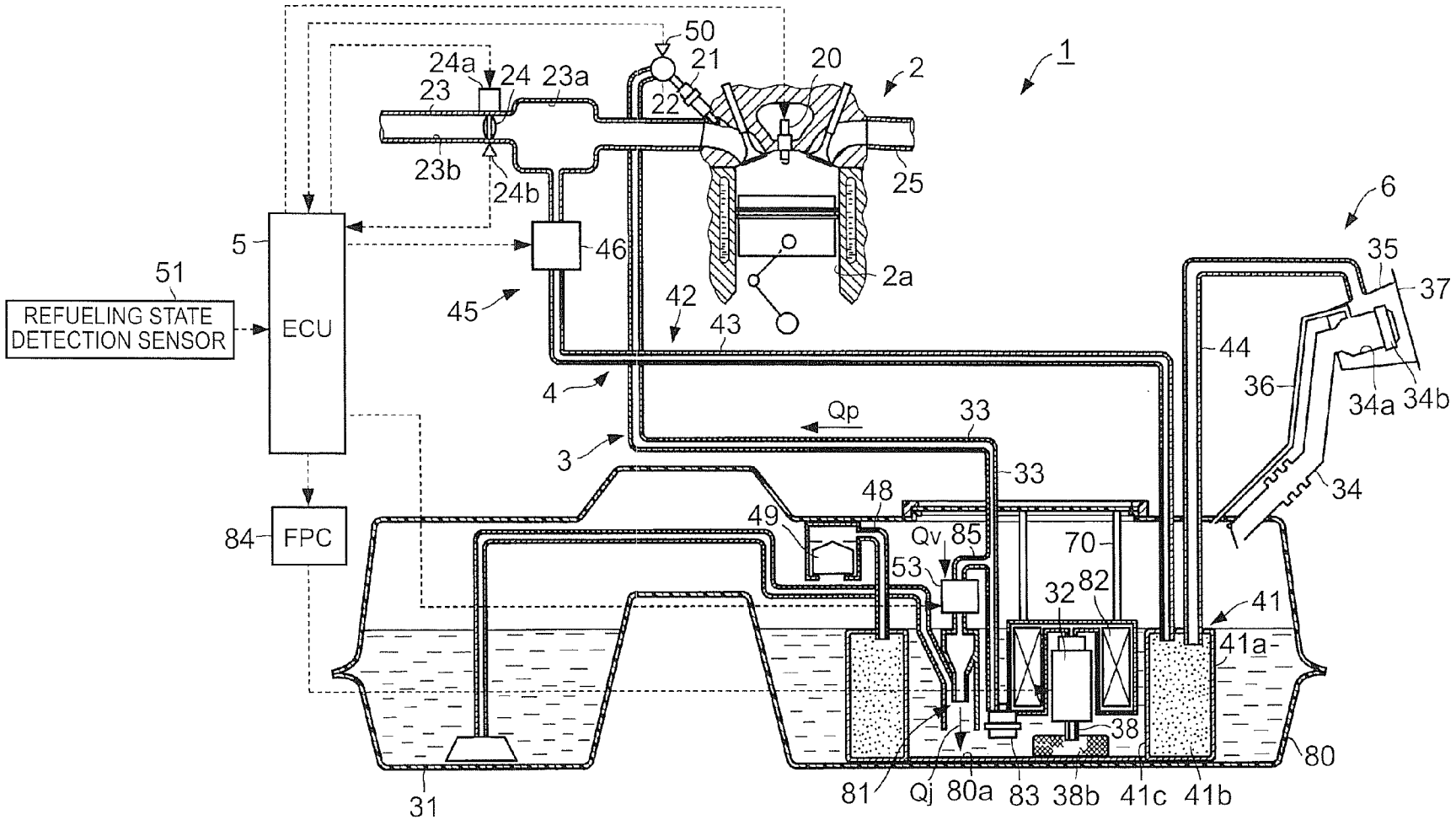
FIG. 7 is a schematic configuration view of a relevant portion, including a driving internal combustion engine and a fuel system of the internal combustion engine, in a vehicle on which an evaporative fuel treatment apparatus according to a second alternative embodiment to the third embodiment of the invention is mounted.

In addition, in each of the first to third embodiments of the invention, the sub-tank 80 may be located outside the fuel tank 31. For example, in the third embodiment of the invention, shown in FIG. 5, the sub-tank 80 and the fuel tank 31 may constitute a saddle-shaped tank as shown in FIG. 7. Similarly, in each of the first and second embodiments of the invention as well, the sub-tank 80 and the fuel tank 31 may constitute a saddle-shaped tank.

As described above, the evaporative fuel treatment apparatus according to the invention provides such an advantageous effect that it is possible to sufficiently exercise the evaporative fuel adsorption performance and adsorbed fuel desorption performance of the adsorber, so it is useful in the evaporative fuel treatment apparatus in which the adsorber is provided inside the fuel tank.

What is claimed is:

1. An evaporative fuel treatment apparatus comprising:
- an internal combustion engine having an intake pipe;
- a fuel tank that stores fuel for the internal combustion engine;
- a sub-tank in communication with the fuel tank;
- a fuel pump that pumps fuel that is supplied from the sub-tank to the internal combustion engine;
- an adsorber provided inside the sub-tank, that adsorbs evaporative fuel generated inside at least one of the fuel tank and the sub-tank;
- a purge mechanism that purges evaporative fuel from the adsorber into the intake pipe of the internal combustion engine; and
- an in-tank fuel adjustment unit that adjusts an amount of fuel inside the sub-tank in response to an operating state of the internal combustion engine, the in-tank fuel adjustment unit including a fuel introduction pump that pumps fuel from an outside of the sub-tank to an inside of the sub-tank, the fuel introduction pump being formed of a jet pump driven by at least part of the fuel pumped from the fuel pump.

2. The evaporative fuel treatment apparatus according to claim 1, wherein
- the in-tank fuel adjustment unit adjusts the amount of fuel inside the sub-tank so as not to increase the amount of fuel on the condition that an increase in the temperature of the adsorber is required.

3. The evaporative fuel treatment apparatus according to claim 1, wherein
- the in-tank fuel adjustment unit adjusts the amount of fuel inside the sub-tank so as to increase the amount of fuel on the condition that a decrease in the temperature of the adsorber is required.

4. The evaporative fuel treatment apparatus according to claim 1, wherein
- the fuel introduction pump is disposed inside the fuel tank.

5. An evaporative fuel treatment apparatus comprising:
- an internal combustion engine having an intake pipe;
- a fuel tank;
- a sub-tank in communication with the fuel tank;
- a fuel pump that pumps fuel that is supplied from the sub-tank to the internal combustion engine;
- an adsorber provided inside the sub-tank, that adsorbs evaporative fuel generated inside at least one of the fuel tank and the sub-tank;

a purge mechanism that purges evaporative fuel from the adsorber into the intake pipe of the internal combustion engine;

a jet pump driven by at least part of the fuel pumped from the fuel pump, the jet pump introduces fuel from an outside of the sub-tank to an inside of the sub-tank; and an electronic control unit operatively connected to the fuel pump, the electronic control unit adjusts an amount of fuel inside the sub-tank in response to an operating state of the internal combustion engine by controlling operation of the fuel pump which at least partially drives the jet pump.

6. The evaporative fuel treatment apparatus according to claim 5, wherein the electronic control unit adjusts the amount of fuel inside the sub-tank so as not to increase the amount of fuel on the condition that an increase in the temperature of the adsorber is required.

7. The evaporative fuel treatment apparatus according to claim 5, wherein the electronic control unit adjusts the amount of fuel inside the sub-tank so as to increase the amount of fuel on the condition that a decrease in the temperature of the adsorber is required.

8. The evaporative fuel treatment apparatus according to claim 5, wherein the jet pump is disposed inside the fuel tank.

* * * * *